United States Patent [19]

Van Steveninck et al.

[11] 4,114,390

[45] Sep. 19, 1978

[54] BURYING A CONDUIT IN THE BOTTOM OF A BODY OF WATER

[75] Inventors: Johannes Van Steveninck, Rijswijk; Jan Lincklaen Arriëns, The Hague, both of Netherlands

[73] Assignee: Shell Oil Company, Houston, Tex.

[21] Appl. No.: 806,128

[22] Filed: Jun. 13, 1977

[30] Foreign Application Priority Data

Jun. 28, 1976 [GB] United Kingdom ..... 28803/76

[51] Int. Cl.[2] ..... E02F 5/02

[52] U.S. Cl. ..... 405/163; 37/62

[58] Field of Search ..... 61/72.4; 37/80, 62, 37/63

[56] References Cited

U.S. PATENT DOCUMENTS

| | | | |
|---|---|---|---|
| 3,576,111 | 4/1971 | Henry, Jr. | 61/724 |
| 3,638,439 | 2/1972 | Niederer | 61/724 |

*Primary Examiner*—Jacob Shapiro

[57] ABSTRACT

The invention relates to a method and apparatus for burying a conduit at the bottom of a body of water.

9 Claims, 1 Drawing Figure

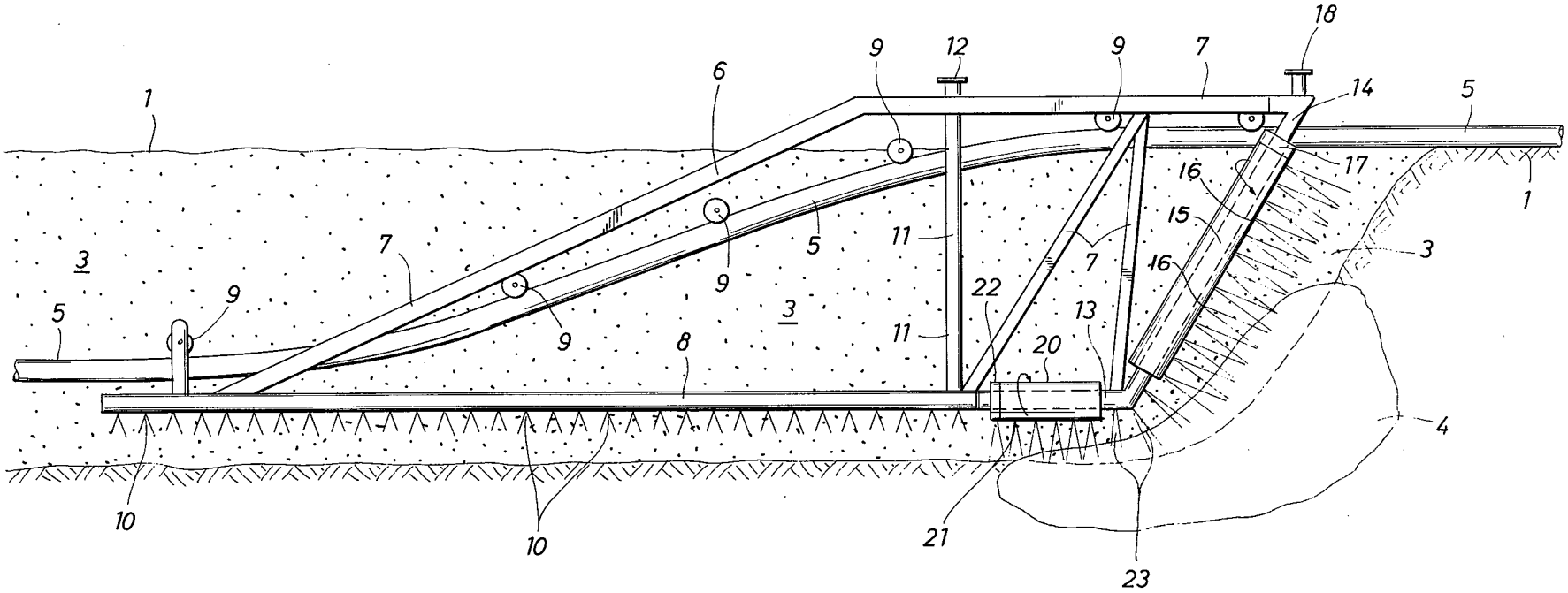
1
5
3
4
14
17
18
7
16
15
16
23
9
7
13
20
22
12
21
11
11
9
5
3
6
9
8
9
10
7
9
1
10
3
5

BURYING A CONDUIT IN THE BOTTOM OF A BODY OF WATER

BACKGROUND OF THE INVENTION

1. Field of the Invention

The invention relates more in particular to such a method and apparatus wherein non-cohesive bottom material, such as for example sand, or soft clay of mixtures of sand and soft clay, is fluidized by injecting a fluid at low velocity and at low pressure into the bottom material and wherein the conduit is allowed to sink into the fluidized bottom material.

2. Prior Art

A related method and apparatus is described in British Pat. Nos. 1,219,879 and 1,291,250. The method of these patents is satisfactory when applied to the burying of a conduit in a bottom of a body of water when the bottom material along the planned route of the conduit is non-cohesive. However, when in certain areas of the planned route of the conduit lumps of cohesive material, for example lumps of hard clay, are present, difficulties may arise when the method of the above kind is applied. This is caused by the fact that the fluid used for the fluidization of the non-cohesive bottom material is injected at low pressure and at low velocity so that the fluid is not able to erode lumps of cohesive bottom material such as hard clay.

In order to erode the lumps of cohesive bottom material high pressure fluid jets can be used, for example having a nozzle pressure drop in the range of about 100 to 1,000 psi.

Power consumption of such high pressure jets is, however, rather high, in particular since a large number of such high pressure jets have to be applied because in cohesive bottom material such as hard clay, each jet issuing from a high pressure nozzle creates a hole having only a small diameter.

Other pertinent art includes U.S. Pat. Nos. 2,659,211; 3,181,301; 3,504,504; 3,638,439; 3,751,927; 3,786,642; 3,877,237.

SUMMARY OF THE INVENTION

It is a purpose of the invention to provide a method and apparatus of the above kind, wherein only a relatively small number of nozzles for the high pressure jets is necessary so that a considerable reduction of the total power consumption of the high pressure jets is obtained.

For this purpose the method of the invention comprises the steps of:

a. displacing a fluidization device along the conduit, b. via the fluidization nozzles of the fluidization device injecting fluid at low velocity and at low pressure into the non-cohesive bottom material adjacent to the conduit so that the non-cohesive bottom material is fluidized, c. allowing the conduit, together with the fluidization device, to sink into the fluidized bottom material, d. If any cohesive bottom material is encountered, eroding the cohesive bottom material by injecting fluid at high velocity and at high pressure into the cohesive bottom material via the fluidization nozzles on the front of the fluidization device, e. during the injection of the fluid at high velocity and at high pressure into the cohesive bottom material, moreover moving the fluidization nozzles on the front of the fluidization device in a direction other than the direction of displacement of the fluidization device, so that a wide opening is formed in the cohesive bottom material by the fluid jets issuing from the said nozzles. Preferably, the movement of the fluidization nozzles according to step *e* is a rotation around an axis.

An apparatus for carrying out the method according to the invention comprises a frame adapted to be displaced along the conduit, fluidization nozzles arranged on the frame, means for supplying fluid at low velocity and at low pressure to the fluidization nozzles, wherein the fluidization nozzles on the front of the frame are arranged in such a manner that they are movable relative to the frame in a direction other than the direction of displacement of the fluidization device, wherein means are present for supplying fluid at high velocity and at high pressure to the fluidization nozzles on the front of the frame and wherein means are present for moving the fluidization nozzles on the front of the frame relative to the frame. Preferably, the fluidization nozzles on the front of the frame are so arranged that they are rotatable around an axis relative to the frame.

DESCRIPTION OF THE DRAWING

The drawing shows a schematic side view of use of the apparatus.

DESCRIPTION OF THE PREFERRED EMBODIMENTS

In the drawing reference numeral 1 indicates the top surface of the bottom of a body of water. A pipeline 5 is laying on the top surface 1. In order to bury the pipeline 5 in a fluidization device generally indicated by reference numeral 6 is displaced along the pipeline 5. The lower part of the frame 7 is provided with two spaced apart parallel tubes 8, each having a large number of fluidization nozzles 10. Each tube 8 is in communication with a fluid supply tube 11 which is provided with a fluid inlet 12. A number of rollers 9 is secured to the frame 7. The front of the fluidization device 6 is provided with two pairs of tubular elements 13 and 14 which are in communication with a fluid inlet 18. Each tubular element of a pair is spaced apart from the parallel to the other tubular element of said pair. Around each tubular element 14 a cylindrical element 15, having a larger diameter than tubular element 14, is arranged in such a manner that it is adapted to rotate around its longitudinal axis. The cylindrical element 15 is provided with a number of fluidization nozzles 16. A motor 17, preferaby a hydraulic motor, is arranged at the top end of the cylindrical element. The cylindrical element 15 is mounted in a fluid-tight manner on the tubular element 14. The tubular element 14 is provided with openings (not shown) which are adapted to create a fluid communication between the space within the tubular element 14 and the space within cylindrical element 15.

Around each tubular element 13 a cylindrical element 20, having a larger diameter than tubular element 13, is arranged in such a manner that it is adapted to rotate around its longitudinal axis. The cylindrical element 20 is provided with a number of fluidization nozzles 21. A motor 22, preferably a hydraulic motor, is arranged at one end of the cylindrical element 20. The cylindrical element 20 is mounted in a fluid-tight manner on the tubular element 13. The tubular element 13 is provided with openings (not shown) which are adapted to create a fluid communication between the space within the tubular element 13 and the space within cylindrical element 20.

The operation of the apparatus as shown in the drawing is as follows. The fluidization device 6, which is basically U-shaped as explained in the patent specification pertaining to British Pat. No. 1,219,879, is placed over the pipeline 5 so that it straddles the pipeline 5.

The fluidization device 6 is displaced along the pipeline 5, for example by pulling it along the pipeline, for example by means of a winch on a work-boat. During this displacement of the fluidization device 6, fluid, for example water, is supplied to fluid inlet 12 and to fluid inlet 18. This water can be supplied to inlets 12 and 18 for example from a boat or barge which is connected to the inlets 12 and 18 by means of hoses (not shown). The water, which is supplied at low pressure and at low velocity to inlet 12, is passed via fluid supply tube 11 and via the tubes 8 of the fluidization device 6 to the fluidization nozzles 10. The water which is supplied at low pressure and at low velocity to inlet 18, is passed via tubular elements 14 and via tubular elements 13, respectively via the openings (not shown) in tubular elements 13 to the spaces within cylindrical elements 15 and within cylindrical elements 20 passes at low velocity and at low pressure respectively through the fluidization nozzles 16 and 21. The water leaving the fluidization nozzles 10, 16 and 21 is injected at low pressure and at low speed into the non-cohesive bottom material, which is for example sand, soft clay, or a mixture of sand and soft clay. The water injected into the non-cohesive bottom material will cause fluidization of said bottom material, so that the fluidized bottom material will behave like a liquid. In the drawing the area of the bottom which is in the fluidized condition is indicated by the reference numeral 3. The area of the bottom which has not yet been fluidized is indicated by the reference numeral 2. Since the bottom material in the fluidized area behaves like a liquid, the fluidization device 6 sinks into the fluidized bottom material until the rollers 9 contact the pipeline 5 and then the pipeline 5 together with the fluidization device 6, sinks into the fluidized bottom material, so that the position is reached as shown in the drawing. By displacing the fluidization device 6 along the pipeline 5 while injecting water via the fluidization nozzles 10 into the bottom material it is possible to bury the pipeline 5, as explained more in detail in the patent specifications pertaining to Applicant's British Pat. Nos. 1,219,879 and 1,291,250.

If non-cohesive bottom material lumps of material are present which are of such a cohesive nature that fluidization is not possible, special measures have to be taken to break up or to erode such lumps of cohesive material.

In the drawing a lump of cohesive material, which consists for example of hard clay, is indicated by the reference numeral 4. As soon as the fluidization device 6 encounters said lump 4, measures are taken to raise the pressure of the water supplied to the fluid inlet 18. This water, which is supplied at high pressure and at high velocity, is passed through the nozzles 16 and 21.

The motor 17, which is for example driven by the water supplied at high pressure to the tubular element 14, drives the cylindrical element 15 so that the cylindrical element 15 rotates around its longitudinal axis. The motor 22, which is for example driven by the water supplied at high pressure to the tubular element 13, drives the cylindrical element 20 so that the cylindrical element 20 rotates around its longitudinal axis. The rotation of the cylindrical elements 15 and 20 can be continuous or instead it can be a swinging movement for example over an angle of 90°.

The water leaving the fluidization nozzles 16, and 21 at high pressure and at high velocity erodes the part of the lump 4 of hard clay which would form an obstacle to the burial of the pipeline. Because of the rotation of the cylindrical elements 15 and 20, the water jets issuing from the nozzles 16 and 21 cover a wide area, so that a wide opening is formed in the lump of cohesive clay 4. Said wide opening allows the passage of the fluidization device 6 and the burial of the pipeline 5.

In the embodiment of the invention as described above, the movement of the fluidization nozzles on the front of the fluidization device, in a direction other than the direction of displacement of the fluidization device, is a rotation around at least one axis. Instead, if desired, the movement of the said nozzles can be a linear movement in a direction other than the direction of displacement of the fluidization device.

If desired, the fluidization nozzles on the front of the fluidization device, may be moved as well in a direction other than the direction of the displacement of the fluidization device, during the supply of water at low velocity and at low pressure to these nozzles.

Some fixed fluidization nozzles 23 may be arranged adjacent to the corner formed by the elements 13 and 14 in order to cover the bottom area near said corner. These nozzles 23 are adapted to be fed as well with the fluid supplied via fluid inlet 18 and like the nozzles 16 and 21, the nozzles 23 are adapted to operate both with fluid supplied at low velocity and at low pressure to cause fluidization of non-cohesive bottom material and with fluid supplied at high velocity and at high pressure to cause erosion of lumps of cohesive bottom material.

What we claim is:

1. A method of burying a conduit in the earth at the bottom of a body of water comprising the steps of:

a. displacing a fluidization device along the conduit, b. via fluidization nozzles of the fluidization device injecting fluid at low velocity and at low pressure into non-cohesive bottom material adjacent to the conduit so that the non-cohesive bottom material is fluidized, c. allowing the conduit, together with the fluidization device, to sink into the fluidized bottom material, d. eroding cohesive bottom material by injecting fluid at high velocity and at high pressure into the cohesive bottom material via fluidization nozzles on the front of the fluidization device, e. moving the fluidization nozzles on the front of the fluidization device in a direction other than the direction of displacement of the fluidization device, so that a wide opening is formed in the cohesive bottom material by the fluid jets issuing from the nozzles.

2. The method as claimed in claim 1, wherein the movement of the fluidization nozzles according to step *e* is a rotation around an axis.

3. The method as claimed in claim 2, wherein the non-cohesive bottom material consists of sand or soft clay or a mixture of sand and soft clay and wherein the non-cohesive bottom material contains lumps of cohesive bottom material in the form of hard clay.

4. The method as claimed in claim 3, wherein the fluid used for the fluidization of the non-cohesive bottom material is water.

5. The method as claimed in claim 4, wherein the fluid used for eroding the cohesive bottom material is water.

6. An apparatus for burying a conduit in the earth at the bottom of a body of water, comprising a frame adapted to be displaced along the conduit, fluidization nozzles along the bottom of the frame and means for supplying fluid at low velocity and at low pressure thereto; fluidization nozzles along the front of the frame which are movable relative to the frame in a direction other than the direction of displacement of the frame, and means for supplying fluid at high velocity and at high pressure thereto; and means for moving the fluidization nozzles on the front of the frame relative to the frame.

7. The apparatus as claimed in claim 6, wherein the fluidization nozzles on the front of the frame are rotatable around an axis relative to the frame.

8. The apparatus as claimed in claim 8, wherein the means for moving the fluidization nozzles on the front of the frame comprise at least one fluid motor.

9. The apparatus of claim 6 including fluidization nozzles at the forward end of the bottom of the frame which are movable about an axis situated relative to the frame in the same direction as the direction of displacement of the frame.

* * * * *